United States Patent [19]

Sendzimir

[11] 4,288,042

[45] Sep. 8, 1981

[54] VARIABLE CAPACITY STRIP ACCUMULATOR ROTATABLE ON A HORIZONTAL AXIS

[76] Inventor: Tadeusz Sendzimir, 269 Brookside Rd., Waterbury, Conn. 06720

[21] Appl. No.: 74,415

[22] Filed: Sep. 11, 1979

[51] Int. Cl.[3] ..... B65H 17/48

[52] U.S. Cl. ..... 242/55; 242/55.19 R; 242/63

[58] Field of Search ..... 242/55, 78.1, 63, 47.08, 242/47.09, 55.16, 55.17, 55.18, 55.19 R, 55.21; 226/118, 119

[56] References Cited

U.S. PATENT DOCUMENTS

| | | | |
|---|---|---|---|
| 3,310,255 | 3/1967 | Sendzimir | 242/78.1 |
| 3,506,210 | 4/1970 | La Tour et al. | 242/55 |
| 3,729,144 | 4/1973 | Bijasiewicz et al. | 242/55 |
| 4,199,116 | 4/1980 | Matsunaga | 242/63 |

*Primary Examiner*—John M. Jillions

*Attorney, Agent, or Firm*—Samuel Lebowitz

[57] ABSTRACT

An accumulating apparatus for storing a variable length of strip material in which said strip is in the form of two adjacent spiral coils mounted on a common horizontal axis. The rolling coils of the accumulator are identical in size but are wound in opposite directions with their inner ends connected to each other by a bridging portion of the strip material which rotates in opposite directions in dependence upon the relative preponderance of the rate of accumulation and/or withdrawal of the strip material into and from the apparatus. Each of the spiral coils is supported on the interior thereof by a system of angularly spaced rollers capable of assuming circular orbits of varying diameters corresponding to the inner diameters of said coils, to control the sag of successive lengths of the strip between the rollers, which facilitates the interface creeping between the successive turns of the coils. This effect may be enhanced by applying tractive forces to the supporting rollers, if found desirable.

21 Claims, 8 Drawing Figures

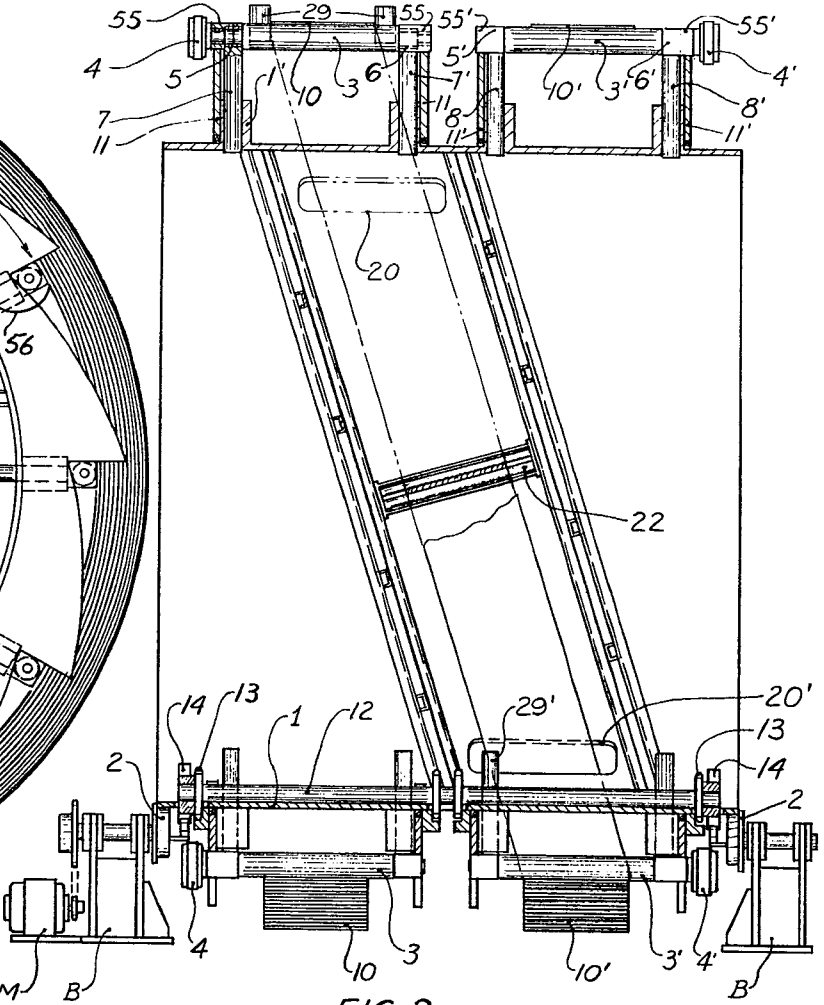
FIG. 2
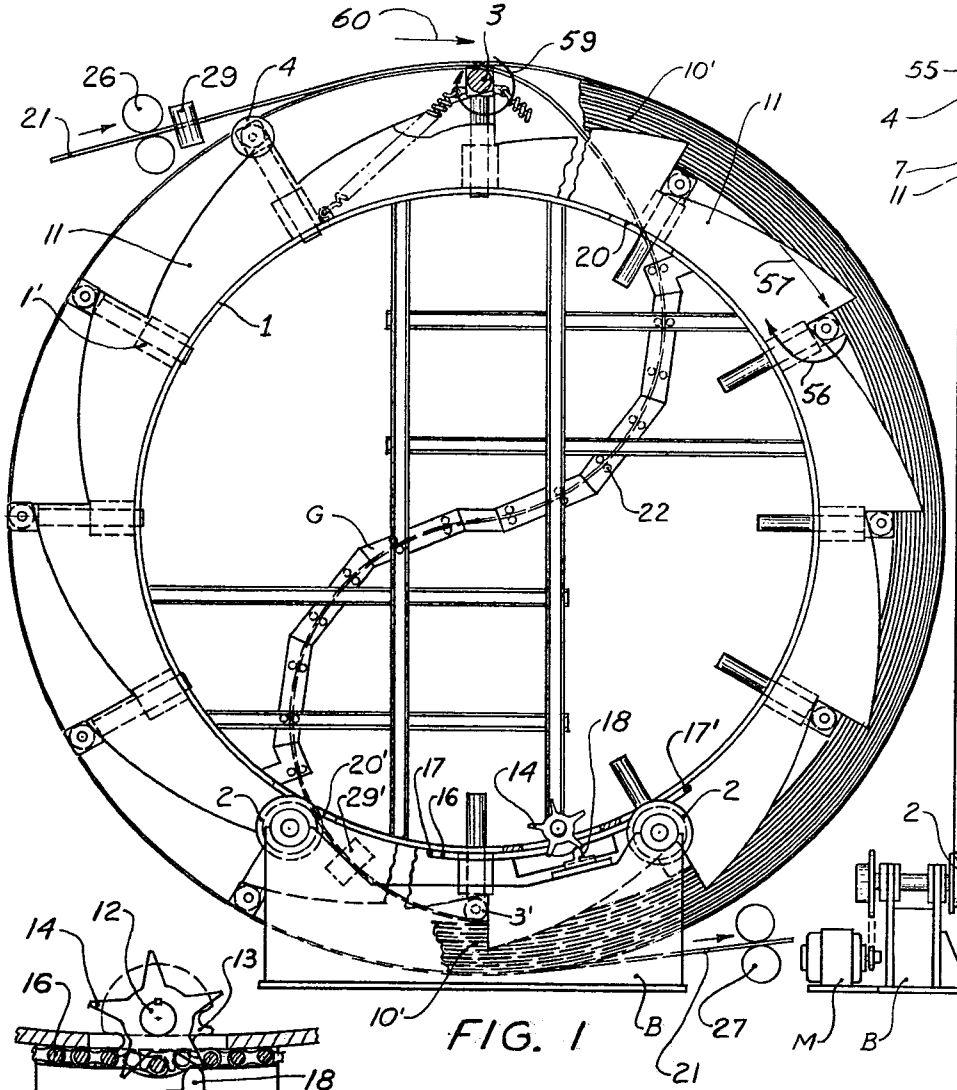
FIG. 1
FIG. 3

VARIABLE CAPACITY STRIP ACCUMULATOR ROTATABLE ON A HORIZONTAL AXIS

The invention concerns an apparatus for intermediate storage of a variable length of metal or other strip material while in lengthwise motion. Such apparatus is necessary at the feeding end of the processing equipment, e.g. steel strip annealing lines which require uninterrupted speed while the strip is furnished in coils of finite length which must be joined together end to end.

My U.S. Pat. No. 3,310,255, Mar. 21, 1967, discloses such apparatus where two spiral coils of strip material are superposed around a vertical axis. Yet, the welders for joining the strips, as well as the downstream processing equipment, require the strip to be in a horizontal position which means that the strip material must be twisted from horizontal into vertical position and back again to horizontal position, which is costly in space and equipment.

This does not happen when the axis is horizontal but when a strip is wound around a horizontal axis to form a coil, starting with the outer convolution which is of fixed diameter (i.e. opposite to usual coil winding) each subsequent convolution must force its predecessors into smaller and smaller diameters, the circumferences of which become progressively shorter and namely by over three times the strip thickness of each convolution. This means that the strip of the inner convolution must constantly creep by that distance from under the surface of its outside neighbor and in doing so it must overcome the friction which is cumulative, exactly like in winding a rope around a block, only in the opposite direction. This is the well-known exponential function where the coefficient of friction and the wrapping angle are in the exponent.

In an accumulator built according to the said U.S. Pat. No. 3,310,255, such relative sliding movement exists in precisely the same proportion but it does not obstruct the progress of accumulation since the individual convolutions practically do not touch each other. But if the same geometric configuration is applied to an accumulator with a horizontal axis, the weight of the convolutions resting on one another causes friction to accumulate, rapidly if the coefficient is high, and more slowly (8–10 convolutions) if the strip is smooth and oiled so the accumulation is brought to a halt.

When that condition is reached, any attempt at continuing the accumulation by adding more convolutions only results in wrinkling the inner coil wraps thus blocking further progress. But at the same time this tendency results from unrelieved stresses within the coil, on the interfaces between individual layers of strip which stresses augment as accumulation progresses.

Applicant has succeeded in developing a method to overcome this difficulty. He takes advantage of the fact that the two coils are not pressed uniformly all around their peripheries: the top part is under pressure of the internal supporting rollers, both lateral parts are essentially relieved of all pressure while the bottom part may or may not be under pressure depending on, whether or not, it is supported by external rollers.

The segments of the coil comprised between two neighboring rollers will sag elastically somewhat under their own weight and the sag will depend on the distance between the rollers, the thickness of the strip, the number of convolutions and the friction coefficient.

Applicant has found that by making that distance between supporting rollers large enough, compatible with correct support and guiding of the strip, he produces minute creeping movements between individual convolutions that balance themselves out at the lateral unloaded coil portions to produce the required total creep at each revolution of the coil.

In case of heavy strip gauges or other conditions causing the coil sag to be not quite adequate, a forward tension applied to the inside convolution of the coil will produce creep of the required magnitude.

Accumulators designed to form coils around a horizontal axis are known. Such are U.S. Pat. Nos. 3,506,210, Apr. 14, 1970, 3,868,065, Feb. 25, 1975, and 3,885,748, May 27, 1975, but the method of accumulation as disclosed in the present application represents a considerable technical progress over the said prior art in the capacity of accumulation, ease and safety of operation and the cost of the corresponding apparatus.

The feed of the strip material is controlled by pinch rolls at the inlet and outlet ends of the accumulator and the smooth feed of the strip material is facilitated by a circular series of supporting rolls on the inner peripheries of the coils, the orbits of which may be controlled in conformity with the varying thickness of the coils. The supporting rolls are spaced circumferentially to permit a controlled sagging of the sheet material therebetween to produce an interfacial creeping between adjacent convolutions of the coils and a consequent ease of the travel of the strip from the inlet to the outlet. This creeping effect may be enhanced by imposing tractive forces on the supporting rolls to facilitate the advance thereof without binding.

Other objects and purposes will appear from the detailed description of the invention following hereinafter, taken in conjunction with the accompanying drawings, wherein FIG. 1 is a front elevation, with certain parts in section, of a preferred embodiment of the invention with the left hand side of the figure illustrating the parts of the accumulator at the start of the operation and the right hand side of the figure showing the position of the parts when the accumulation of material is almost complete;

FIG. 2 is a vertical sectional view along the central portion of FIG. 1, with parts in elevation, with the upper portion of the figure illustrating the position of the parts at the start of the accumulating operation and the bottom portion of the figure illustrating the parts at the conclusion thereof;

FIG. 3 is an enlarged view of a detail shown in FIG. 1, for controlling the orbit of the supporting rollers;

Figure 4:
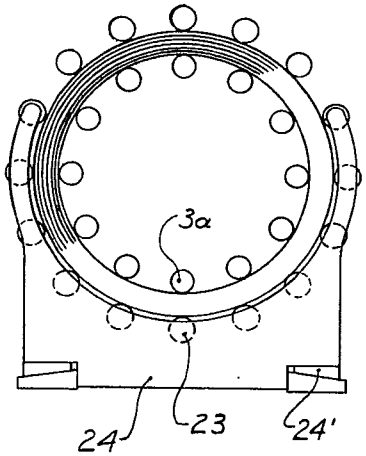
FIG. 4 is a schematic view of another embodiment of the invention providing an additional supporting cage of rolls for the outer peripheries of the coils shown in FIGS. 1 and 2.

The embodiment shown in FIGS. 1 and 2 consists of a cylindrical rotor 1 which is supported and driven by four flanged wheels 2 located in the base B of the apparatus. Rotor 1 is surrounded by two circles of rollers 3,3' which may be driven by known means such as individual motors 4,4', and which are located in bearings 5, 6 and 5',6', respectively, which are held in holders 7,7' and 8,8' respectively. These holders are axially slidable in bores provided in radial protrusions 1' spaced equidistantly around the periphery of rotor 1. As shown in FIG. 1, the rollers are displaced 30° from each other which permits sagging of the strip between adjacent rollers, and enhances the interfacial creeping between adjacent turns.

Rollers 3 support and propel the first coil 10 of strip material 21 which is being stored in the apparatus, by engaging the inner wrap of said spiral coil 10. The advancing tractive force exerted on the strip of the inner wrap is indicated by the arrow 60, arising from the clockwise rotation of roller 3 as indicated by arrow 59. Since the strip material follows the spiral path of the first coil 10 beginning with the first convolution which is the outer wrap (shown in upper half of FIG. 2), and is of fixed diameter and continues along the spiral into wraps of progressively smaller diameter, (shown in lower half of FIG. 2), the circle of supporting rollers 3 and the bearing supports therefor are provided with means for adjusting the diameter of the roll circle to conform to the actual diameter of the inner wrap as the accumulation progresses. To this end, outside bearings 55 are provided adjacent bearings 5 and are mounted in chocks that rest upon and can slide along the slopes of a series of circumferentially arranged cams 11 which are rotatably mounted upon the rotor tube 1 beyond the protrusions 1'.

Similarly, rollers 3' arranged coaxially with rollers 3 support the first coil or convolution of strip material 21 which is guided from the incoming material adjacent one end of the rotor through the opening 20 in the latter and reversed in direction in the interior thereof by the S-shaped guide channel G for passage through the exit slot 20' in the rotor 1, adjacent to the other end thereof. The slots 20 and 20' are diametrally opposite each other but are offset along the length of the rotor and are bridged by the angularly disposed channel G wherein are fitted guide rolls 22, as shown in FIG. 1.

The rollers 3' engage the inner wrap or convolution of the second spiral coil 10' as shown at the lower half of FIGS. 1 and 2, which is of variable diameter and continues along the spiral 10' into convolutions of progressively larger diameter for eventual withdrawal from the outer wrap by pinch rolls 27. The retarding tractive force exerted by rollers 3' on the inner wrap of the second coil is indicated by arrow 57 which is caused by the clockwise rotation of rollers 3', as indicated by arrow 56.

As is the case with rollers 3, each roller 3' is provided with outside bearings 55', the positions of which are controlled by the cam segments of rotatable cam rings 11' mounted on the rotor 1 at the opposite ends of rollers 3'.

To effect synchronous rotation of the two discs 11 relative to one roll 3 mounted on rotor 1, by an arc equal to one cam surface of disc 11, FIGS. 1, 2 and 3 show exemplary means for adjusting the radial position of rollers 3 relative to the periphery of rotor 1. A shaft 12 is mounted in bearings affixed to the inner surface of cylindrical rotor 1 in parallel to the axis of rotation thereof. A Geneva wheel 14, provided with five prongs, is keyed onto each outer end of said shaft with the prongs in engagement with chain sprocket 13. A short length of roller chain 16 has the opposite ends thereof 17, 17' connected to the outer discs 11 and engages the sprockets 13 adjacent thereto. As rotor 1 makes one revolution during accumulation of the strip material, one prong of the Geneva wheel 14 strikes the lug 18 mounted upon the base of the apparatus, to turn said sprocket by one tooth, thereby causing a minute rotation of disc 11 accompanied by sliding of bearing chocks 55 down the slope of said cam, thus incrementally diminishing the diameter of the circle of supporting rollers 3 by the thickness of one wrap of the coil. Other strip material thicknesses require, of course, sprockets with other numbers of teeth. The reverse happens when the stored length of strip is being diminished.

The spacing between rollers 3 must be such that the length of the coil sector between two neighboring rollers 3 will flex slightly under its own weight each time a roller is passed, causing all strips in that area to creep slightly, one against the other, so that the inner (downstream) wraps advance slightly against the outer (upstream) wraps, since the velocity of the strip material is uniform while the inner wraps are progressively shorter along the spiral curve.

In cases where interface friction between wraps is very high, a drive or tractive force may be applied to supporting rolls 3', which creates a pulling force exerted upon the strip material at each roll and which serves to promote such forward creep.

As stated above, the S-shaped transfer guide G for the strip material on its way from the inner wrap of the first coil 10, reverses the winding direction of the strip into the inner wrap of the second coil 10'. This guide is contained inside rotor 1 to which it is firmly attached. It consists of a rigid channel supporting a plurality of spaced pairs of guide rollers 22 disposed along the S-curve, which are parallel to each other, except for the two extremities of said curve where said strip material must be slightly twisted to follow the angle of transfer to the second coil, and untwisted again as it approaches said second coil.

Whereever, chiefly owing to interfacial strip friction, it is preferable to apply driving power to said guide rollers 22, solid rollers similar to rollers 3 with individual motors similar to motors 4, shown in FIG. 2 are used rather than short guide rollers 22 fitted within beam mounting therefor as shown in FIG. 1.

As described above, the second coil 10' beginning with the inner wrap or convolution exits tangentially at the end of the outer wrap, being pulled with sufficient tension by the exit pinch rolls 27. In order to overcome the interleaf friction which tends to accumulate as the number of convolutions increases, relief is attained by constant flexing of the coil strip as it passes from one to the next supporting roll 3', as explained in connection with the convolutions of the first coil. The pull exerted by exit pinch rolls 27 thus cooperates with that flexing action to promote the above-mentioned slight interleaf creeping action all along the spiral curve.

In operation, in order to thread the accumulator, the holders 7,7' of support roller bearings 5 are first moved to their outermost position to support the outer wrap of the first coil, by rotating camwheel 11 to the extreme counterclockwise position. Next, the leading end of strip 21 is fed in by entry pinch rolls 26 and through the space between any two support rollers 3, then through slot 20 in the wall of rotor 1, through the guide G and slot 20' and again between two of the opposite supporting rolls 3', and around the circle of rollers 3' supporting the second coil 10' and finally through exit pinch rolls 27 for pulling action by the latter. In order to load the accumulator, the exit pinch rolls 27 are stopped while the entry pinch rolls 26 continue to feed more strip material. The first coil 10 continues to rotate but the second coil is stationary together with the exit pinch rolls 27. The rotor 1 with guide G rotates, so that each revolution in the clockwise direction (FIG. 1) deposits one convolution on the inside of each of both coils, thus continuing their spiral curves. Simultaneously, both cam wheels 11,11 continue to rotate clockwise to gradually reduce the diameter of the circular orbit of the supporting rollers 3,3' to permit the successive turns of coils 10 and 10' to follow their spiral curves.

When the exit pinch rolls 27 are actuated to feed the downstream processing machinery while the accumulator is still being filled, and if both the entry and exit speeds are the same, both coils continue to rotate at the speeds of the respective pinch rolls but the rotation of rotor 1 with its guide G stops, with the number of wraps in the spiral turns of both coils remaining steadily the same.

When, on the contrary, the entry pinch rolls 26 are stopped, as for joining the next coil, the first coil is stopped together with the entry pinch rolls and, since the second coil and the exit pinch rolls 27 continue their uninterrupted feeding of the downstream equipment, rotor 1 with its guide G rotates counterclockwise, as viewed in FIG. 1, to reduce one inner turn of each of the two coils with each revolution.

Strip material 21, whatever its width, is preferably maintained in the center of supporting rolls 3,3' and for this purpose, adjustable edge guide rolls 29 conforming to the width of the strip 21, are provided near the entry pinch rolls 26, for the first coil 10, and edge guide rolls 29' are positioned where said strip enters the inner wrap of the second coil 10' (FIG. 2).

For coils with a large buildup, I prefer to use the emodiment as shown in FIG. 4 where both the first and second coils are surrounded, at least around the lower part of their peripheries, by arcs of supporting rollers 23, coaxial with said coils and of a fixed radius corresponding to the outside diameter of said coils.

The frame 24 supporting said arcs is preferably made adjustable in height, as by wedges 24' in order to distribute the weight of the coils between the external supporting rolls 23 and the internal rolls 3a. In fact, if a coil of thin strip material is flexible enough, it is preferable to let it hang loosely upon the inner rolls 3a and assume a slightly oval shape, adjusting the height of rollers 23 to support only the overhanging lower half of the coil.

Supporting rollers 23 may be driven to cause the coils to rotate and, especially in case of the second coil, to also exert a pull on the outer wraps to promote interfacial creeping, as described above. Internal rolls 3a need not be driven in such case, although, with heavy coils it is preferable to provide such drive and even, especially for the second coil, to exert a retarding torque upon the internal rolls 3a to obtain more uniform interfacial creeping of the wraps of said coil, in cooperation with the pull exerted by the exit pinch rolls.

Figure 5:
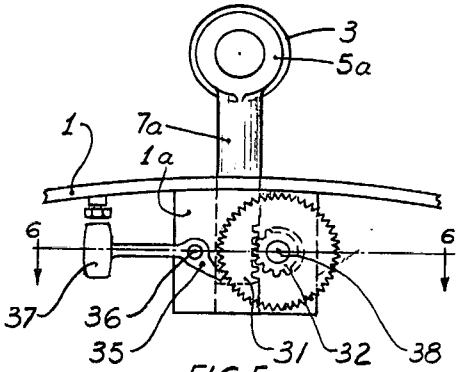
FIG. 5 is a front elevation of another embodiment of the mountings for the supporting rolls 3 on the inner peripheries of the coils.
Figure 6:
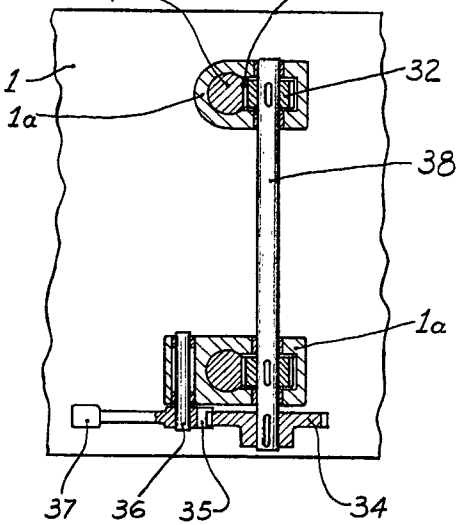
FIG. 6 is a horizontal sectional view along line 6—6 of FIG. 5, with certain parts in elevation.

The embodiment shown in FIGS. 5 and 6 illustrates a simplified arrangement for gradually increasing or decreasing the diameter of the circle of the internal supporting rollers to conform to the diameter of the inner wraps of both coils. Shanks 7a, holding the bearings 5a of rollers 3, are slidably mounted in the bores of attachments 1a extending inwardly of the rotor 1. A gear rack 31 is provided on a side of each shank which meshes with a pinion 32 keyed onto a shaft 38 and journalled in both attachments 1a appurtenant to each roller 3. This assures parallelism of rollers 3 with the axis of the coil. A toothed wheel 34 with V-shaped teeth of a fine pitch is keyed at one end of shaft 38, the teeth of which may be engaged with a pawl 35 pivoting around shaft 36 located in a bore in the attachment 1a. The opposite end of pivoted pawl 35 has a lever with a counterweight 37 at its end, which exerts differential control on the rollers 3 during the upper and lower portions of their orbit. Each time roller 3 is in the lower half of its circle, the counterweight 37 pulls the pawl 35 out of engagement with wheel 34, thus rendering shanks 7a free to slide, while roller 3 remains in contact with the inner wrap of the coil, which position corresponds to the correct radius of the inner wrap of the coil at the moment. As soon as the roller reaches the upper half of the circle, counterweight 37 swings downward (FIG. 5), pushing pawl 35 into engagement with wheel 34, which solidly blocks both shanks 7a and their roller 3 in that radial position, by the engagement of racks and pinions 31,32, so that the roller can bear its share of the weight of the coil.

Figure 7:
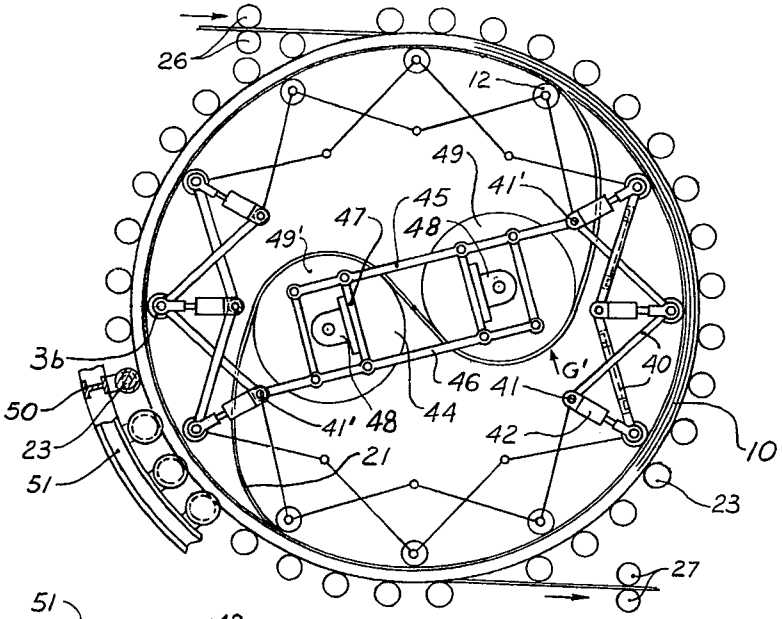
FIG. 7 is a front elevation of another embodiment of the invention.
Figure 8:
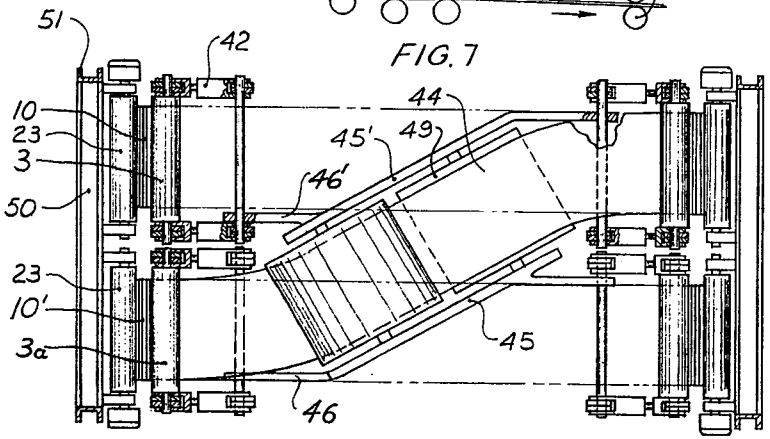
FIG. 8 is a sectional view along the horizontal centerline of FIG. 7, with certain parts in elevation.

The accumulator in accordance with the invention may be varied in size to suit special needs. At times, they are built in rather small dimensions, for strips only a couple of inches wide. If such strip is made of a material sufficiently elastic, the inner wraps support themselves and the inner roll circle is not needed. For intermediate sizes, I prefer to use an economical embodiment shown in FIGS. 7 and 8, wherein the inner rotor carries the supporting rollers 3b and the central S-curve guide G'. The rotor is conceived as a floating shearleg frame body where shearlegs 40 are articulated around points 41. The exterior articulating points also carry bearings 5a for rollers 3b, there being two such circular shearleg frames for each circle of rollers, with suitable cross-ties to insure their parallelism. Fluid cylinders 42, two for each roller 3b, tend to expand the structure thereby pressing the rollers 3b against the inner wraps of the coils. The crossties are extended to also connect the rotor frames of coil 10 to that of coil 10' since the diameters of the inner wraps of both coils are identical at all times.

The S-curve guide G' leading the strip from the inner wrap of coil 10 to the inner wrap of coil 10' is affixed to this structure. This guide is based on articulated frames consisting of four longitudinal beams 45,45', 46,46', each being rotatably linked to one of two diametrally opposite articulated joints 41' of said rotor frame, and rotatably cross-linked by several parallel connecting link-beams 47, two pairs of which are provided with bearings 48 for locating shafts of two guide pulleys 49,49'. At least the second (downstream) of said pulleys is preferably provided with a torque motor to produce a certain pull on the strip.

Beams 45,45' are further rigidly cross-linked by ties (not shown), to insure rigidity of the structure. Moreover, since with diminishing internal diameter of both coils, the angle between beams 45, 45', 46, 46' and the rotor axis is also altered, one of each pairs of articulating joints 41' is also provided with a telescoping capability.

In the case of accumulators of large capacity, an external circle of supporting rollers 23 may be provided, whose bearings are located on cross-beams 50 of a circular frame 51, which may be mounted on the floor similarly to frame 24 shown in FIG. 4.

I claim:

1. The method of transiently storing a variable length of strip material on two adjacent spiral coils rotating on a common horizontal axis with the convolutions of the coils wound in opposite directions, comprising (a) winding the incoming strip of material into one coil and withdrawing the strip from the other coil while the connection between the inner portions of the two coils moves in opposite directions in response to the relative preponderance of the rate of accumulation and exhaustion of the strip of material from the coils as they increase and decrease in diameter, (b) supporting the inner periphery of each of the spiral coils with a plurality of circumferentially displaced supporting rollers which permit sagging of the strip between adjacent rollers in their elevated orbit and the consequent freedom of movement and creeping between the juxtaposed windings of the strip material, and (c) adjusting the circular orbit of the supporting rollers in conformity with the variation of the diameters of the inner peripheries of the spiral coils to maintain the support of the innermost windings of the coils and the resultant sagging and creeping effects of the strip material for all thicknesses of said spiral coils.

2. The method set forth in claim 1, including the step of imposing an advancing tractive force on the supporting rollers of the innermost winding of the first coil to enhance the freedom of movement of the innermost windings relative to the adjacent windings.

3. The method set forth in claim 2, including the step of imposing a retarding tractive force by the rollers adjacent to the innermost winding of the second coil to reduce the binding effects of the adjacent windings in the course of their withdrawal therefrom.

4. An apparatus for storing a variable length of forwardly advancing strip material disposed in two adjacent spiral coils rotatable on a common horizontal axis with the convolutions thereof of substantially the same circumference but coursing in opposite directions, comprising (a) transition means between the coils on the interior thereof for effecting the reversal of the direction of the convolutions, (b) a plurality of circumferentially distributed rollers in contact with the inner convolution of each spiral coil, and (c) means for varying the radial orbit of said rollers in response to the varying inner diameter of said coils.

5. An apparatus as set forth in claim 4, wherein said rollers are displaced at least 12° from each other to permit the sagging of the strip material therebetween.

6. An apparatus as set forth in claim 4, including a cage of rollers for supporting the outer peripheries of the spiral coils.

7. An apparatus as set forth in claim 6, including means for adjusting the elevation of said last-mentioned cage of rollers relative to the radial orbit of said first-mentioned rollers.

8. An apparatus as set forth in claim 4, including radially extending supports for the opposite ends of each roller, and means for adjusting said supports in correspondence to variations in the internal diameter of said coils.

9. An apparatus as set forth in claim 8, including a plurality of camming surfaces for controlling the extension of said supports.

10. An apparatus as set forth in claim 4, including means for adjusting the radial orbit of said rollers only during the travel of the rollers through the lower portion of said orbit.

11. An apparatus as set forth in claim 10 wherein said last-mentioned means comprises a radially movable bar connected to each roller and provided with a toothed portion along an edge thereof, a rotary shaft supporting a wheel having teeth in meshing engagement with said toothed portion and a second wheel having a toothed periphery, and a rockable arm having a rocking pawl at one end thereof and a counterweight at the opposite end thereof adapted to disengage said pawl from said toothed periphery by gravitational effect during the time of travel of said rollers through the lower portion of said orbit.

12. An apparatus as set forth in claim 4, wherein said transition means comprises a shearleg structure with bearings for said rollers mounted thereon, and means for urging said rollers outwardly to cause said structure to float inside said coils without any external bearing supports.

13. An apparatus as set forth in claim 12, including a cage of rollers for supporting the outer peripheries of the spiral coils.

14. An apparatus as set forth in claim 4 wherein said transition means comprises a shearleg structure with bearings for said rollers mounted on the outer boundary thereof and comprising beams in the central portion of said structure supporting a pair of bearings, and two parallel guide pulleys mounted in said bearings adapted to guide said strip for approximately a half turn on each to delineate an S-curve and thereby to effect the reversal of the direction of the convolutions.

15. An apparatus as set forth in claim 14, including a cage of rollers in said first-mentioned bearings for supporting the outer peripheries of the spiral coils.

16. An apparatus for accumulating transiently a large quantity of rolling sheet material in the course of its travel in a horizontal plane from an intermittently operating source of supply to a continuously operating point of utilization, without twisting the sheet from its planar form, comprising (a) a unitary supporting cylinder for the sheet material rotatably mounted on a horizontal axis, (b) means for accumulating said sheet material on the exterior of said unitary cylinder in the form of a pair of laterally displaced spiral coils with the convolutions thereof coursing in opposite directions, (c) means for feeding the sheet material in a horizontal plane onto said unitary cylinder to form the first of said pair of spiral coils, (d) means on the interior of said cylinder for guiding said material from the innermost convolution of said first spiral coil to the innermost convolution of the second spiral coil, and (e) means for withdrawing the sheet material in a horizontal plane from the outermost convolution of said second of said pair of spiral coils.

17. An apparatus as set forth in claim 16, including a plurality of supporting rollers for each of said spiral coils at a plurality of circumferentially and uniformly displaced points of said supporting cylinder, and bearing supports for each group of supporting rollers.

18. An apparatus as set forth in claim 17, including drive means for said supporting rollers to exert a tractive effort to the sheet material in contact therewith.

19. An apparatus as set forth in claim 17, including means for adjusting the radial distances of said rollers relative to said supporting cylinder corresponding to the inner diameter of the coil supported thereby.

20. An apparatus as set forth in claim 19, wherein each of said rollers is provided with bearing supports, and said adjusting means comprises a cam wheel assembly adjacent to said bearing supports having a plurality of circumferentially distributed camming edges to control the elevation of said rollers corresponding to the accumulation of convolutions of the spiral coils.

21. An apparatus as set forth in claim 19 wherein said adjusting means comprises:

(a) a cam wheel assembly adjacent to each group of bearing supports,
(b) a rotary shaft mounted in bearings affixed to the inner surface of said supporting cylinder,
(c) a multi-prong Geneva wheel keyed to each end of said shaft,
(d) a chain sprocket in engagement with said prongs,
(e) a short length of chain connected to each outer cam wheel in engagement with the respective sprocket adjacent thereto,
(f) a lug in the path of said Geneva wheel to cause it to rotate by one tooth at each revolution of said cylinder and thereby to effect rotation of the cam wheel relative to said cylinder by a small angle, thus causing axial displacement of all bearing supports.

* * * * *